United States Patent [19]

Puccini

[11] 4,288,672

[45] Sep. 8, 1981

[54] ILLUMINATED KEYBOARD APPARATUS

[75] Inventor: Richard E. Puccini, Taunton, Mass.

[73] Assignee: Texas Instruments Incorporated, Dallas, Tex.

[21] Appl. No.: 106,777

[22] Filed: Dec. 26, 1979

[51] Int. Cl.[3] ..... H01H 9/18

[52] U.S. Cl. ..... 200/314; 200/159 B; 200/317

[58] Field of Search ..... 200/314, 317, 159 B, 200/5 A, 16 B

[56] References Cited

U.S. PATENT DOCUMENTS

| | | | |
|---|---|---|---|
| 3,982,081 | 9/1976 | Demler, Jr. | 200/159 R |
| 4,056,700 | 11/1977 | Stanner | 200/16 |
| 4,060,703 | 11/1977 | Everett, Jr. | 200/159 B |
| 4,163,125 | 7/1979 | Boulanger | 200/159 B |
| 4,163,138 | 7/1979 | Harden | 200/317 |
| 4,163,883 | 8/1979 | Boulanger | 200/314 |

FOREIGN PATENT DOCUMENTS

| | | | |
|---|---|---|---|
| 2512228 | 10/1975 | Fed. Rep. of Germany | 200/314 |

*Primary Examiner*—Willis Little

*Attorney, Agent, or Firm*—John A. Haug; James P. McAndrews; Melvin Sharp

[57] ABSTRACT

A keyboard system is disclosed which is particularly useful in vehicle control panels in which illumination of key indicia is desired to facilitate identification and actuation of selected keys. The system includes a housing for mounting key switches in a selected array. Disposed in the housing is a frame having key receiving apertures extending through a top wall of the frame and mounting a circuit board thereunder. The circuit board includes a normally open electrical contact set aligned with each key receiving aperture. The frame is composed of light transmitting material and is arranged to transmit light from a light source mounted below the circuit board into and through the key identification indicia formed in a label disposed on top of the frame. In one embodiment the indicia is in alignment with the pushbutton members through which light is directed while in another embodiment the indicia is located adjacent the pushbutton members.

13 Claims, 12 Drawing Figures

ILLUMINATED KEYBOARD APPARATUS

This invention relates generally to keyboards and more specifically to illuminated keyboard systems particularly useful in vehicular applications.

In recent years the use of key actuated switches arranged in selected arrays has become widely accepted. Among the uses for automobiles and other vehicles include controls for ignition switching, trip computers and the like where it is desirable to provide some form of illumination to facilitate identification and actuation of the controls. Although it is known to employ backlighting for such control systems there has been a need for a simple, reliable, inexpensive system which is compact and easily fitted in areas where little space is available, as in the dashboards of automobiles. Recent advances in keyboard technology has made available keyboards in which the keys and their respective switches are closely spaced to maximize the use of a given area which tends to exacerbate the illumination problem. One system which has been found useful employs key arrays in which light pipes have been molded into each key. This approach, requiring triple shot molding techniques for the keys is not only relatively expensive it is also generally unsatifactory with regard to uniformity of light distribution with those keys further removed from the light source receiving less light than those closer to the light source.

It is an object of the invention to provide a simple, reliable, inexpensive illuminated keyboard system which is characterized by having indicia identifying the keys uniformly lit. Another object is the provision of such a keyboard system which is compact and occupies a minimal amount of space. Yet another object of the invention is the provision of a keyboard system which is easily manufactured and assembled. Other objects, advantages and details of the novel and improved keyboard system of this invention appear in the following detailed description of preferred embodiments of the invention.

The detailed description referring to the drawings in which.

Figure 1:
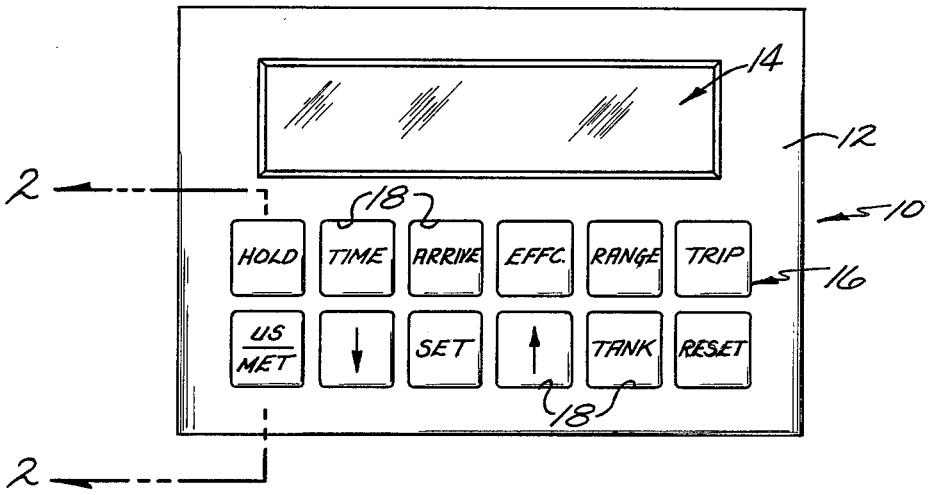
FIG. 1 is a top plan view of a keyboard system of this invention.

Briefly, in accordance with the invention an illuminated keyboard system in a first preferred embodiment comprises a frame member composed of light transmitting material, such as acrylic, having a top wall with at least two rows of apertures extending therethrough. The top wall is relatively long and narrow with a leg depending from and generally coextensive with each long side. The legs extend downwardly beyond a circuit board assembly which is received between the legs in close proximity with the bottom surface of the top wall of the frame. A plurality of switches are mounted on the top face of the circuit board with a switch in alignment with each aperture in the top wall of the frame. A pushbutton key member formed of light transmitting material, which may be the same material as that of the frame, is slidably received in each top wall aperture. A label being opaque except for selected indicia which are transparent, is placed on top of the top wall of the frame with an escutcheon received on top of the label and frame. A light source is disposed beneath the circuit board so that light is transmitted to first light reflecting surfaces on the distal free ends of the legs and is directed upwardly through the leg to second light reflecting surfaces on the attached ends of the legs and is directed laterally into the top wall of the frame and into the pushbutton key members. A light interrupting surface is located on the bottom surface of the key members and is maintained in the light path formed by the top wall so that the laterally directed light is reflected upwardly through indicia aligned with each push button key member to provide an extremely uniformly illuminated keyboard display. The label is a flexible sheet of material and a selected force applied at any of the key locations causes the respective key member to slide downwardly to actuate a switch located beneath the key member. A protrusion extends downwardly from the key member and is aligned with the central portion of a snap acting disc to snap from a convex configuration to an opposite concave configuration to effect a bridging electrical connection between contacts spaced below the disc.

In a second preferred embodiment the indicia through which the light is directed is located adjacent to the pushbutton key members rather than in alignment therewith as in the first embodiment. The second embodiment employs a light transmitting frame with a top wall similar to that of the first embodiment but has only one downwardly extending leg which is generally coextensive with one of the long sides. This leg is used to transmit light laterally into the top wall of the frame in selected areas between that side of the frame and the first row of key member receiving apertures. At these selected areas light interrupting surfaces are located on the bottom surface of the top wall in vertical alignment with the selected areas to cause the laterally transmitted light to be reflected upwardly through the indicia portions on a label placed thereover. Intermediate the two rows of apertures and between the aperture of each pair in the rows light pipes extend downwardly through the circuit board located beneath the top wall of the frame to dispose light reflecting surfaces in light receiving relationship with a light source located beneath the circuit board. Light is directed up through each light pipe and is directed laterally into the top wall of the frame in two opposite directions to a respective light interrupting surface disposed on the bottom surface of the top wall in vertical alignment with an area adjacent to each key member receiving aperture of a pair of key member apertures. Opaque pushbutton key members are slidably received in the apertures of the top wall of the frame and extend through aligned apertures in the top wall of an escutcheon employed to mount the frame. Slots are disposed in the top wall of the escutcheon in alignment with the light interrupting surfaces and a label is received on top of the top wall of the escutcheon with the key members extending through apertures in the label. The label includes light transmitting indicia located adjacent to respective pushbutton key members in alignment with the light interrupting surfaces on the bottom surface of the frame's top wall. A back screened sheet of polyester film, such as polyethylene terephthalate, in the order of 5 mils in thickness has been found to be suitable for the label.

Figure 2:
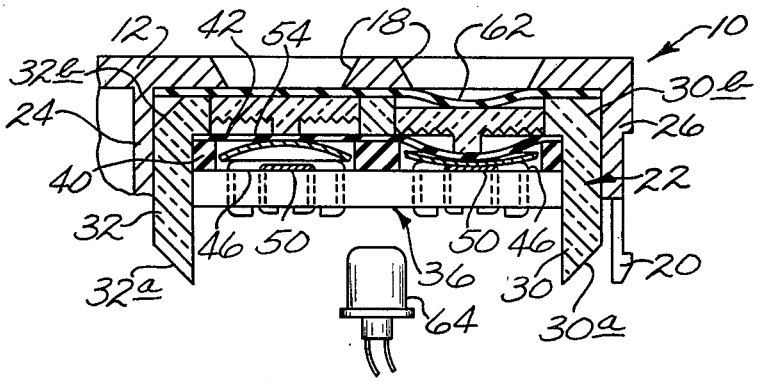
FIG. 2 is a cross sectional view taken on lines 2—2 of FIG. 1 and showing one key switch in the unactivated position (left hand side of the view) and one key switch in the actuated position (right hand side of the view)
Figure 3:
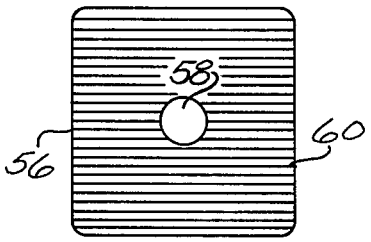
FIG. 3 is a bottom plan view of a key member used in the first embodiment.
Figure 4:
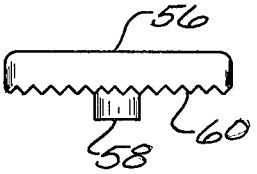
FIG. 4 is a front elevational view of the FIG. 3 key member.
Figure 5:
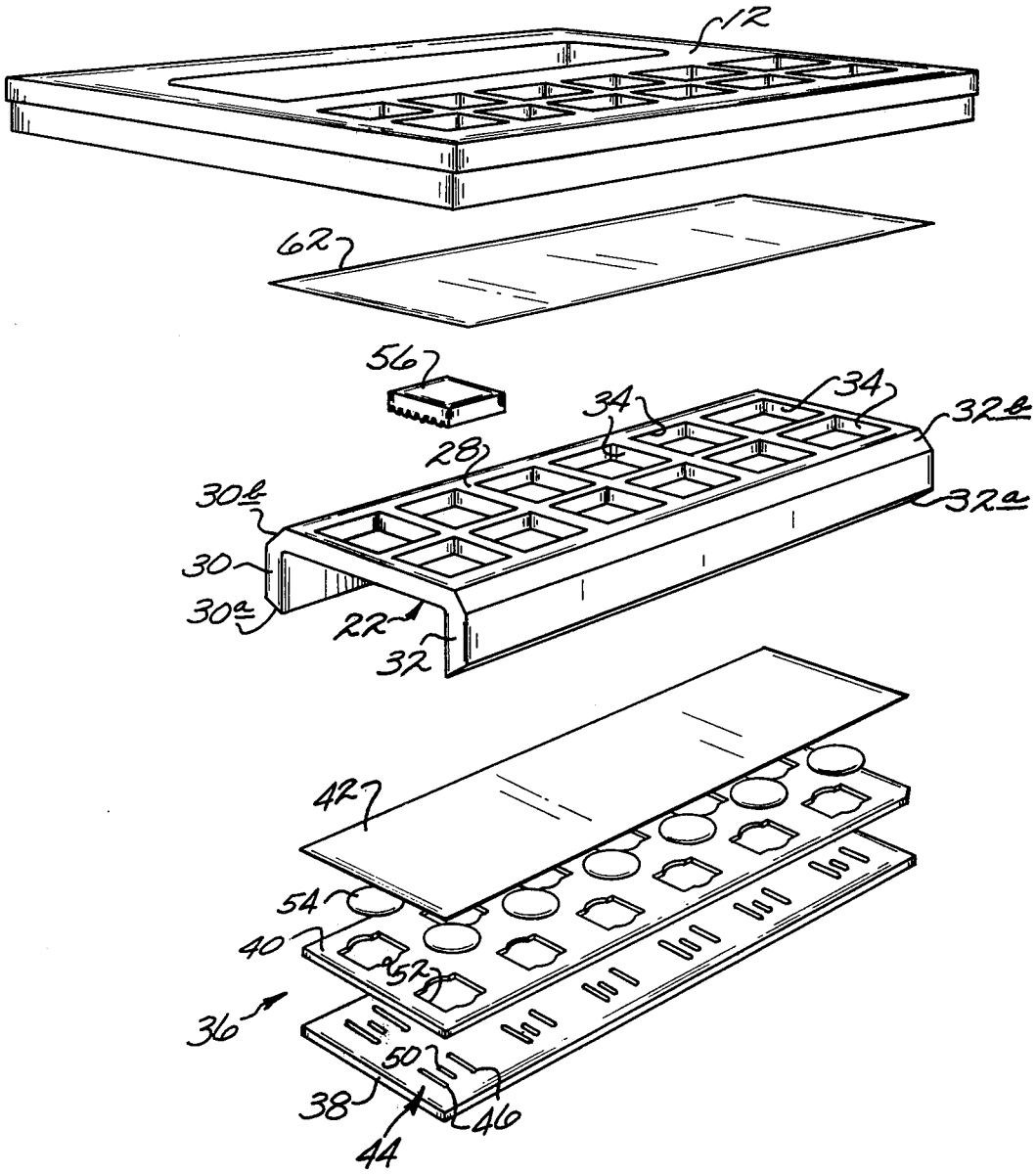
FIG. 5 is a blown apart perspective of the first embodiment of the invention but not showing the light source and showing only a single key member and disc for ease of illustration.
Figure 6:
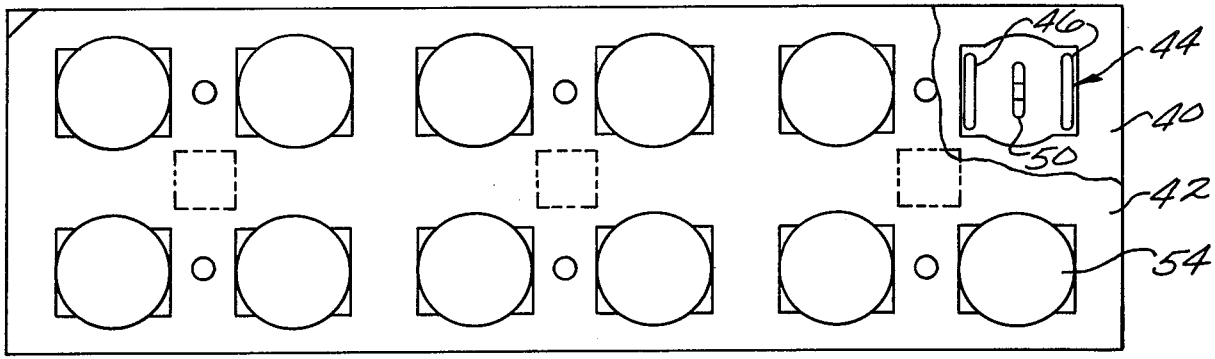
FIG. 6 is a top plan view of the circuit board assembly seen in cross section in FIG. 2 and shown with a portion broken away to show a contact set.

Turning now to the drawings, keyboard system 10 comprises a bezel 12 which may be of suitable plastic, opaque material having a display portion 14 and a keyboard portion 16. Keyboard portion 16 includes a plurality of apertures 18 each in alignment with a key switch. As seen in FIG. 2 bezel 12 is provided with tab means 20 for mounting the system in a suitable opening in a control panel of a vehicle.

A generally rectangular frame 22 formed of light transmitting material is received between side walls 24 and 26 of bezel 12. Frame 22 is relatively long and narrow and comprises a top wall 28 with legs 30, 32 depending from the top wall along the long sides. A plurality of key receiving apertures 34 are formed in top wall 28 and are arranged to be in alignment with apertures 18 in bezel 12.

Figure 7:
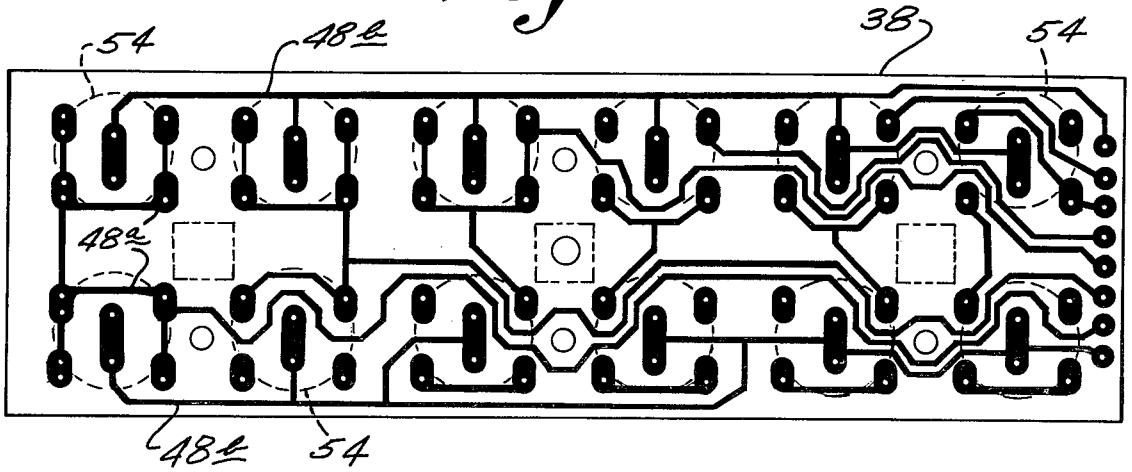
FIG. 7 is a bottom plan view of the FIG. 6 circuit board showing circuit paths which the switches interconnect.
Figure 8:
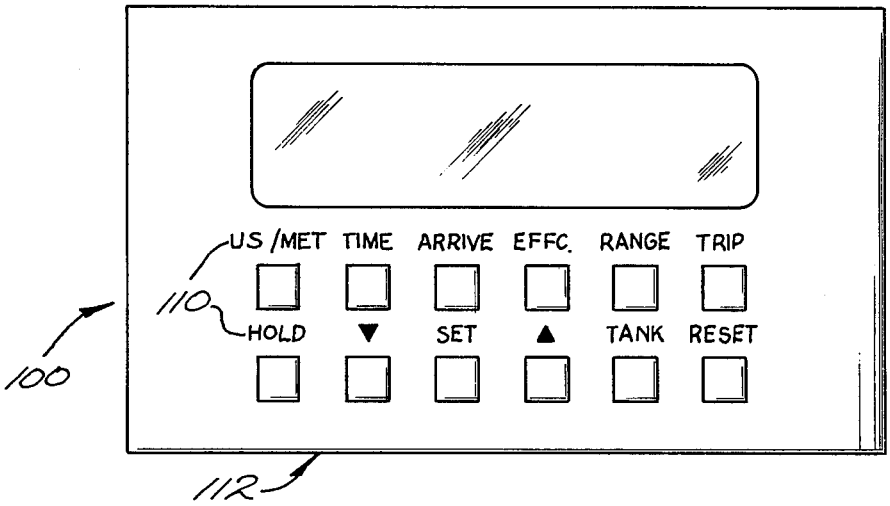
FIG. 8 is a top plan view of a second embodiment of the invention.
Figure 9:
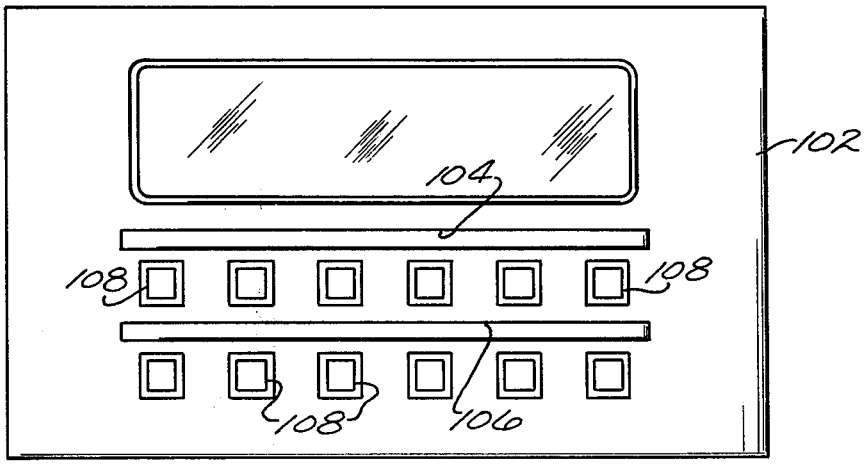
FIG. 9 is a view similar to FIG. 8 but with the label removed to show details of the keyboard escutcheon.
Figure 10:
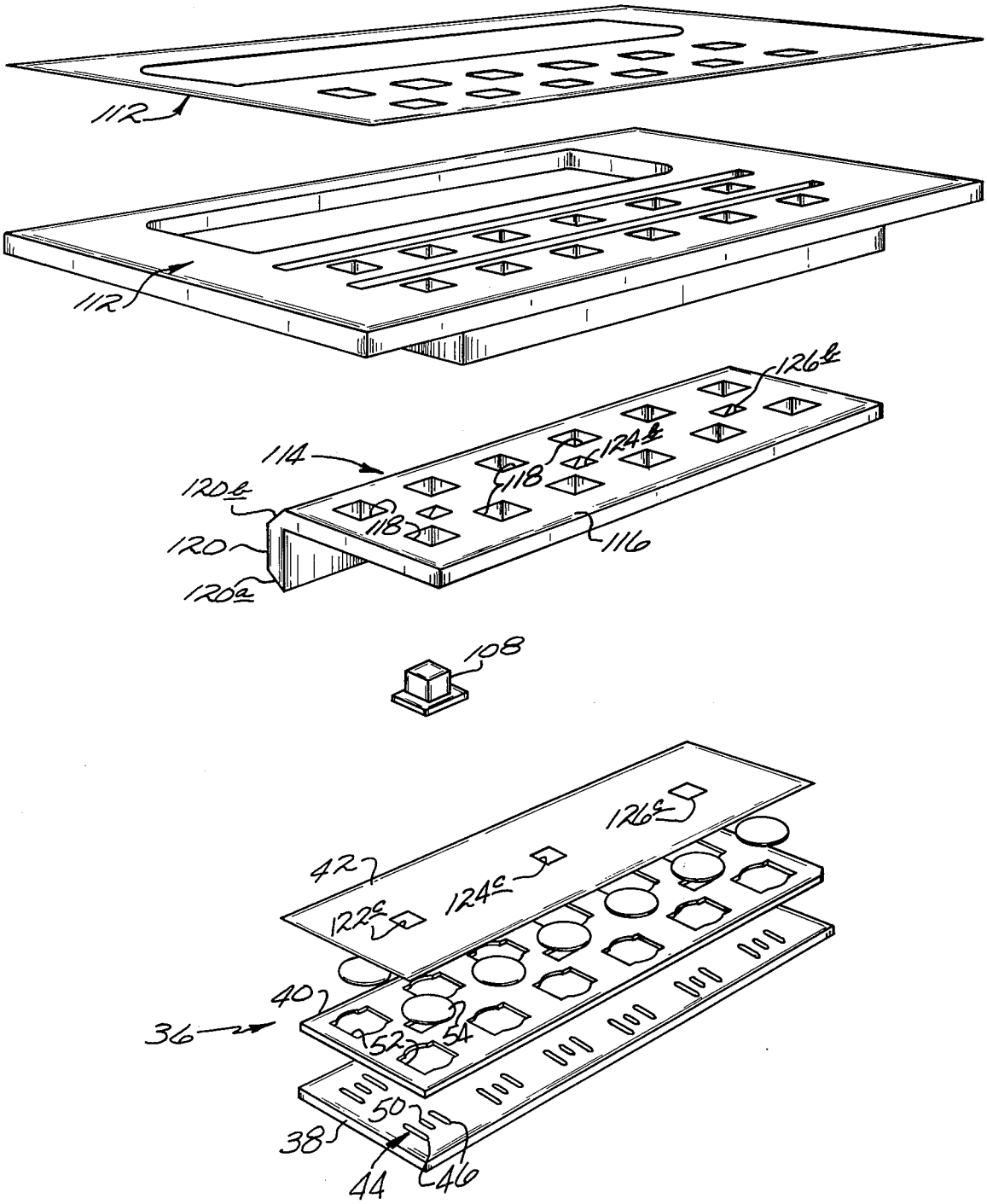
FIG. 10 is a blown apart perspective view of the second embodiment similar to FIG. 5 of the first embodiment.
Figure 11:
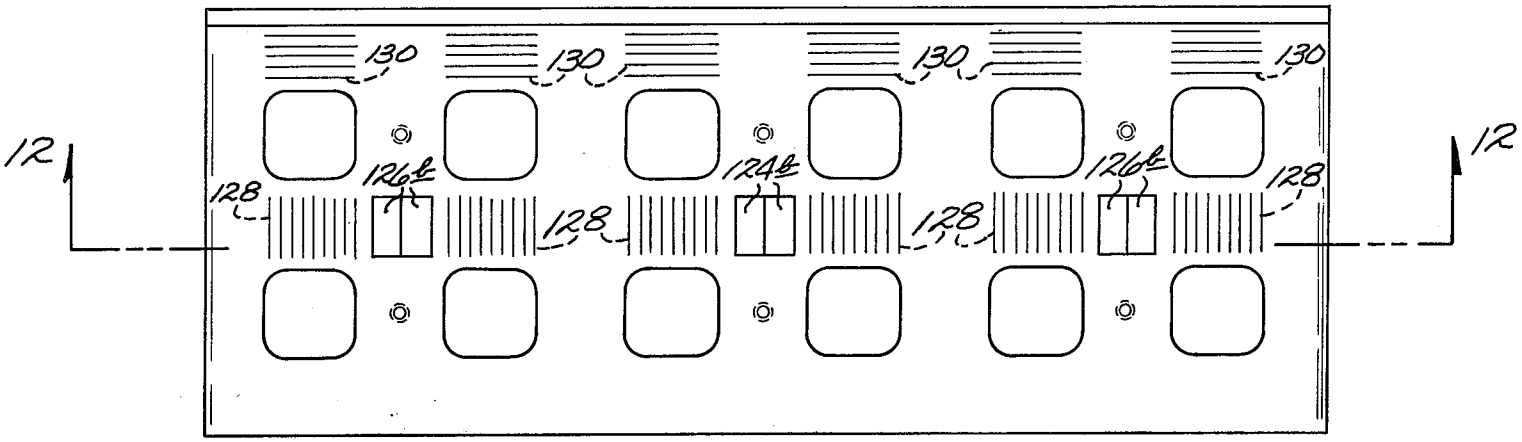
FIG. 11 is a top plan view of a light transmitting frame used in the second preferred embodiment.

A circuit board assembly 36 is received beneath top wall 28 and between legs 30, 32 of frame 22. Assembly 36 comprises an electrically insulative substrate 38, a disc retainer 40 also of electrically insulative material, and an overlying, flexible, electrically insulative layer 42. A plurality of contact sets 44 are mounted on the top surface of circuit board 38, each comprising a pair of outer electrically conductive, generally u-shaped staple like elements 46 having legs which extend through bores formed in board 38 and are soldered to selected circuit paths **48*a* formed in a conventional manner on the bottom surface of circuit board 38 (see FIG. 7). Another electrically conductive, generally u-shaped staple like element 50 having a shorter bight portion and preferably formed of smaller diameter wire than elements 46 is located intermediate elements 46. Element 50 also has legs which extend through bores in board 38 and are soldered to selected circuit paths 48*b* formed on the bottom surface of board 38**.

Disc retainer 40, formed of suitable fiber board material, or the like, is formed with a plurality of disc receiving apertures 52 arranged to be in alignment with the contact sets 44. In each aperture 52 an electrically conductive disc shaped element 54 is disposed. Disc element 54 is formed with a disk like or dome configuration so that when placed on a contact set 44 the outer periphery of the disc will be supported by the outer pair of contact elements 46 but will be out of touch with center contact element 50 as seen in the switch shown in the left half of FIG. 2. A downwardly directed force placed on the center of disc 54 will cause it to deflect with a sudden, snap like motion to move into physical contact with center contact element 50 to thereby form an electrical bridge between elements 46 and 50 as seen in the right half of FIG. 2. Using smaller diameter wire for the center contact provides a slight differential in distance between it and a plane intersecting the top portion of contact elements 46 an thereby enhances the tactile feel of switch actuation since it permits the center portion of disc element 54 to pass through center in moving from a convex to a concave configuration. The switch means are conventional and are shown in detail in U.S. Pat. No. 3,725,907, and will not be further described herein. It will be understood that although two rows of eight switches are shown in the system any desired number of switches can be provided within the scope of the invention.

Each of the apertures 34 formed in top wall 28 of frame 22 slidably receives a close fitting key member 56 formed of light transmitting material, such as acrylic. A protrusion 58 is centrally disposed on the bottom surface and is used to transfer actuation force from the key member to disc 54. Also formed on the bottom of keys 56 is a light interrupting surface in the form of serrations 60. The height of key member 56, including protrusion 58, is approximately the same as the thickness of wall 28 which in turn is selected so that it will efficiently transmit light. A thin sheet 62 of flexible material is placed between frame 22 and bezel 12. Sheet 62 is formed so that it is opaque except for selected indicia through which light can be transmitted.

Legs 30 and 32 of frame 22 are formed with light reflecting surfaces **30*a*, 30*b*, and 32*a*, 32*b* at the bottom and top portions respectively thereof. A suitable light source 64 is disposed beneath circuit board 36 and between legs 30, 32 so that light is transmitted to the bottom portions of legs 30, 32 and is internally reflected upwardly by bottom reflecting surfaces 30*a*, 32*a* and then laterally inwardly by top reflecting surfaces 30*b*, 32*b*. The light is interrupted by serrations 60 on the bottom surface of keys 56 and caused to be reflected upwardly through the indicia on sheet 62**.

The light transmitting material for frame 22 and pushbutton key members 56 is an acrylic or the like having a suitable refractive index, the material preferably being clear to provide high light transmission and being adapted to be molded with very smooth surfaces therein.

First and second reflector surface means **30*a*, 32*a* and 30*b*, 32*b* are molded smooth, and are polished if necessary, so that as a result of the difference between the refractive index of the frame material and the relatively lower refractive index of the air surrounding the frame light which impinges on the surfaces of the frame at an angle equal to or greater than the critical angle of the total internal reflection for the light transmitting material is conducted at least partly through the material of the frame and into the pushbutton key members. The spacing between pushbutton key members and the frame is kept to within approximately 0.002 and 0.005 inch to enhance light transmission into the key members. The thickness of frame 22, including legs 30, 32 is chosen to be equal to or greater than approximately 0.1 inch and preferably approximately 0.125 inch. A depth of approximately 0.01 inch for serrations 60** in the bottom surface of the key members has been found to be suitable.

An alternate embodiment 100 is shown in FIGS. 8–12 in which the indicia is aligned with portions of the light transmitting frame adjacent to the key members rather than having the key members directly illuminated. Thus bezel 102 is formed with transversely extending slots 104, 106 adjacent to key members 108. Key members 108 do not transmit light but, as will be explained below, light is transmitted through slots 104, 106 to illuminate indicia 110 formed on sheet 112 which is opaque except for indicia 110 which is rendered transparent.

Frame 114 of light transmitting material, such as acrylic or the like, is formed with a top wall 116 in which a plurality of key receiving apertures 118 have been formed. A single leg 120 depends from wall 116 along one long side and is formed with bottom and top light reflecting surfaces 120*a*, 120*b* respectively.

Figure 12:
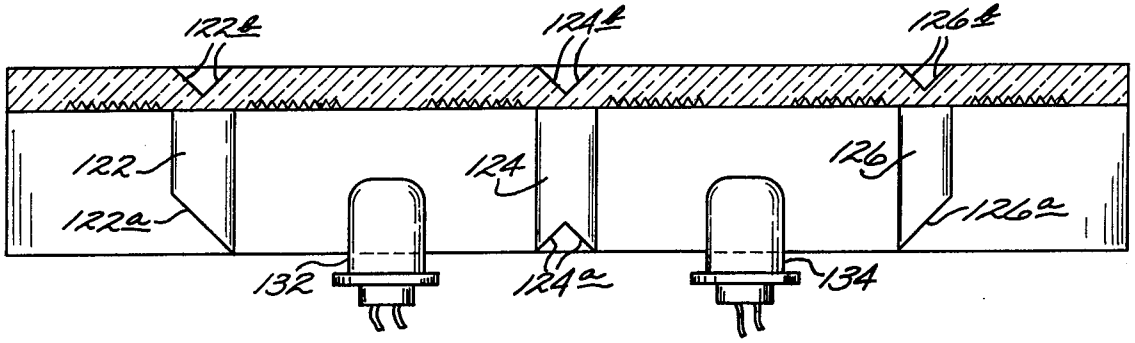
FIG. 12 is a cross sectional view taken on lines 12—12 of FIG. 11.

Light pipes 122, 124 and 126 depend from the bottom of wall 116, as seen in FIG. 12 and extend through holes 122*c*, 124*c* and 126*c* in the circuit board assembly and are located so that they are in alignment with slot 106 and the bottom row of indicia formed on sheet 112. Light pipe 122 is formed with a single bottom light reflecting surface 122*a* and a double top-V shaped light reflecting surface 122*b*. In like manner light pipe is formed with a single bottom light reflecting surface 126*a* and double top-V shaped light reflecting surface 126*b*. light pipe 124 is formed with double bottom and top light reflecting surfaces 124*a* and *b* respectively.

Light interrupting surfaces, such as serrations 128, are formed in the bottom of wall 116 on opposite sides of each of the light pipes 122, 124 and 126 and in alignment with indicia on sheet 112. It will be noted that the serrations extend in length in a direction which is perpendicular to the direction in which the light is transmitted.

Serrations 130 are also formed in the bottom of wall 116 adjacent to leg 120 and extend in a direction parallel to the side of wall 116 from which leg 120 depends.

Light sources 132, 134 are placed between the light pipes and beneath circuit board assembly 36 so that light is transmitted not only up through leg 120 via light reflecting surfaces 120*a* and 120*b* to light interrupting surfaces 130 but also up through each of the light pipes 122, 124 and 126 to light interrupting surfaces 128. Light is reflected from surface 128, 130 up through slots 106, 104 and the respective indicia aligned therewith.

It should be understood that although preferred embodiments of the invention have been described by way of illustrating the invention, this invention includes all modifications and equivalents of the disclosed embodiments falling within the scope of the appended claims.

I claim:

1. Keyboard apparatus comprising an escutcheon adapted to be mounted in a panel of a vehicle and having a surface with a plurality of key apertures therein, a thin flexible sheet underlying the escutcheon surface, the sheet having portions which are opaque and indicia portions which transmit light, a frame underlying the escutcheon surface and the flexible sheet, the frame being composed of light transmitting material, the frame having a top wall with a plurality of key member receiving apertures extending therethrough, key members composed of light transmitting material slidably received in respective key member receiving apertures, the key members each having a protrusion extending from a bottom surface thereof, light interrupting means formed on the remainder of the key member bottom surface, a circuit board disposed beneath the top wall of the frame, the circuit board having a plurality of switches mounted thereon, a switch being aligned with each aperture in the top wall of the frame so that depression of a key member by a force acting through the flexible sheet will cause actuation of a switch, the frame having light transmitting legs having first and second end portions, the legs depending downwardly from the second end portions and extending beyond the circuit board and terminating at the first end portions, a light source disposed beneath the circuit board, first light reflector surfaces located at the first end portions of the legs and arranged to reflect light from the light source up the legs to the second end portions, and second light reflector surfaces located at the second end portions of the legs and arranged to reflect light received from the first reflector surfaces laterally toward key member apertures and their respective key members whereby light transmitted from one of the second reflector surfaces will be reflected upwardly by the light interrupting surface on the bottom of a key member and through the transparent indicia portion of the flexible sheet.

2. An illuminated keyboard system comprising a frame of light transmitting material having a top wall formed with at least two rows of apertures extending therethrough, a circuit board disposed beneath the top wall, the circuit board having a switch on a face thereof aligned with each aperture in the top wall, a key member slidably received in each aperture and adapted upon downward movement to actuate its respective switch, a light source disposed beneath the circuit board, at least two legs integrally formed with and extending downwardly from the top wall of the frame beyond the circuit board; the two legs each having a first free distal end portion with a first light reflecting surface formed thereon, the light reflecting surfaces arranged to reflect light from the light source upwardly through its respective leg, the legs each having a second end portion to the frame and a second light reflecting surface formed at each second end portion, the second light reflecting surfaces arranged to reflect light received from the first reflecting surfaces laterally through the top wall of the frame, a label disposed above the top wall, the label having indicia portions which transmit light, and light interrupting surface means disposed in the top wall of the frame and so located to reflect the laterally directed light upwardly through the indicia portions of the label.

3. A system according to claim 2 in which the key members are composed of light transmitting material and the light interrupting surface means is disposed on a bottom surface of the key members.

4. A system according to claim 3 in which the light interrupting surface means comprises serrated grooves.

5. A system according to claim 2 in which the light interrupting surface means is disposed on a bottom surface of the top wall of the frame.

6. A system according to claim 2 in which the frame is relatively long and narrow and the legs extend generally along the entire length of the frame.

7. A system according to claim 2 in which the frame is relatively long and narrow and at least one leg extends generally along the entire length of the frame.

8. A system according to claim 7 in which the second leg includes a plurality of light pipes, the circuit board formed with light pipe apertures and a light pipe received in and extending through a respective light pipe aperture.

9. A system according to claim 8 in which indicia portions are arranged in at least two rows corresponding to the at least two rows of apertures in the top wall of the frame and their respective switches, the one leg is adjacent one row of indicia portions and a light pipe is disposed between each pair of indicia portions in a second row of indicia portions.

10. A system according to claim 3 in which the top wall of the frame has a top and bottom surface for a selected thickness to effect efficient light transmission and the key members are movable within their apertures with the light interrupting surface means being limited to movement between the top and bottom surfaces of the top wall.

11. A system according to claim 10 in which the key members are each formed with a protrusion formed on the bottom surface of the key to transmit force to its respective switch.

12. A switch according to claim 3 in which indicia on the label is aligned with the key members and the switches are actuated by depression of the key members through the label.

13. A system according to claim 5 in which an escutcheon having a top wall is placed on top of the top wall of the frame, the label is received on top of the top wall of the escutcheon, the indicia forming at least two rows, and a slot is formed in the escutcheon top wall in alignment with each row of indicia, the label being formed with key member receiving apertures and the key members extending through respective key receiving apertures in the label.

* * * * *